United States Patent [19]

Novatny

[11] Patent Number: 4,545,482

[45] Date of Patent: Oct. 8, 1985

[54] U-SHAPED SUPPORT PAD FOR APPLIANCES AND THE LIKE

[75] Inventor: Donald F. Novatny, Marion, Ohio

[73] Assignee: Boise Cascade Corporation, Boise, Id.

[21] Appl. No.: 598,738

[22] Filed: Apr. 10, 1984

[51] Int. Cl.[4] ..... B65D 85/00

[52] U.S. Cl. ..... 206/320; 206/599; 206/586

[58] Field of Search ..... 206/599, 386, 596, 598, 206/586, 591, 326, 592, 320

[56] References Cited

U.S. PATENT DOCUMENTS 2,970,797 2/1961 Desbois .

3,434,435 3/1969 Achermann et al. .

4,391,202 7/1983 Carter et al. .

*Primary Examiner*—Joseph Man Fu Moy

*Attorney, Agent, or Firm*—Laubscher & Laubscher

[57] ABSTRACT

A support pad formed from a pair of corresponding horizontal vertically spaced rectangular blanks each divided by a pair of parallel fold lines into a center panel and a pair of side wall panels. In one embodiment, the blanks are joined by a pair of spacer members adhesively bonded between corresponding side wall panels of the blanks. The center panel of one blank contains a line of severance parallel with the fold lines, and cut out portions on opposite sides of the line of severance that define sets of corresponding dovetail projections and grooves. The relative distances between the fold lines, the height of the dovetail projections, and the combined thickness of the spacer members are such that when the side wall assemblies defined by the bonded side wall panels and spacer members are folded upwardly to vertical positions relative to the bottom center panel, the dovetail projections may be brought manually into interlocking engagement with the corresponding grooves, thereby to maintain the side wall assemblies in the vertical position. In a second embodiment, the spacer members are omitted.

7 Claims, 5 Drawing Figures

U-SHAPED SUPPORT PAD FOR APPLIANCES AND THE LIKE

BRIEF DESCRIPTION OF THE PRIOR ART

It is known in the prior art to provide pallets and support pads formed from corrugated paperboard and other suitable materials for use in shipping and handling appliances, furniture and the like. Examples of such known prior art are the patents to Achermann et al U.S. Pat. No. 3,434,435, Paridon U.S. Pat. No. 1,206,898, Nelson U.S. Pat. No. 2,026,698 and Sorensen et al U.S. Pat. No. 2,996,276, among others. Furthermore, in the patent to Korrol U.S. Pat. No. 2,463,780, a metal base is folded to define a rigid open-bottom box-like base for juke-boxes and the like, the side walls of the blank being joined by interlocking dovetail projections and corresponding grooves. Corner reinforcing members may then be spot-welded within the corner, if desired.

In the past, it was normally the practice in manufacturing support or protective pads from corrugated paperboard to maintain the assembled parts in position by permanent fastening means, such as staples, tape, glue or the like. The permanently assembled pads required considerable storage space, particularly when they had a U-shaped or tray-like open-ended configuration. The known U-shaped shipping pads required three layers of material, and thus were relatively costly.

The present invention was developed to avoid the above and other drawbacks of the known support pads.

SUMMARY OF THE INVENTION

Accordingly, a primary object of the present invention is to provide a support pad that is initially manufactured, shipped and stored in a flat condition, and which is readily assembled by the use of self-locking means into a U-shaped configuration for supporting appliances, furniture and the like. The support pad comprises a pair of corresponding rectangular blanks formed from corrugated paperboard or the like, each blank being divided by a pair of parallel fold lines into a center panel and a pair of side wall panels. In the preferred embodiment, the blanks are joined, when in a vertically spaced horizontal condition, by a pair of spacer members formed of corrugated paperboard, wood or the like bonded between corresponding side wall panels of the blanks. The upper or top blank contains a line of severence between and parallel with the associated pair of fold lines, whereby when the line of severence is severed, the side wall assemblies defined by the side wall panels bonded to the spacer members may be folded upwardly about the fold lines contained in the bottom blanks toward vertical positions relative to the bottom center panel. In an alternate embodiment, the spacer members may be omitted.

According to a more specific object of the invention, the support pad is self-locking to maintain the side wall assemblies in the vertical position without the use of glue, staples or other fastener means. To this end, cut outs are formed in the top blank on opposite sides of the line of severence to define cooperating dovetail projection and grooves, whereby when the line of severance in the center panel of the top blank is severed and the side wall assemblies are pivoted upwardly toward their vertical positions, the severed portions are displaced toward each other a distance equal to the height of the dovetail projection, thereby to permit the dovetail projection to be manually inserted in interlocking relation with the corresponding groove. By maintaining the support pad blank in the initial flat condition until the time of use, there is a savings in shipping and warehouse volume of almost 75%. Moreover, owing to the novel design of the support pad, only two corrugated paperboard blanks are required per U-shaped support pad, as distinguished from the prior support pads that required two or more layers.

A further object of the invention is to provide a self-locking corrugated paperboard U-shaped support pad for appliances such as refrigerators, that will support the appliance on the assembly line during manufacture, and ultimately be used in the shipping container as inner packaging. The support pad may be used both at the top and bottom of the article, thereby to protect the same.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
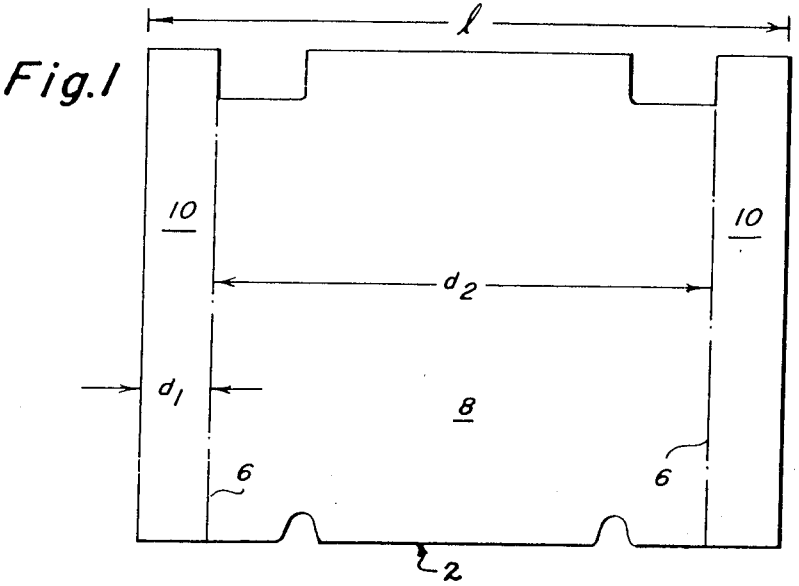
FIGS. 1 and 2 are plan views of the bottom and top blanks, respectively, from which the U-shaped support pad of the present invention is formed.
Figure 2:
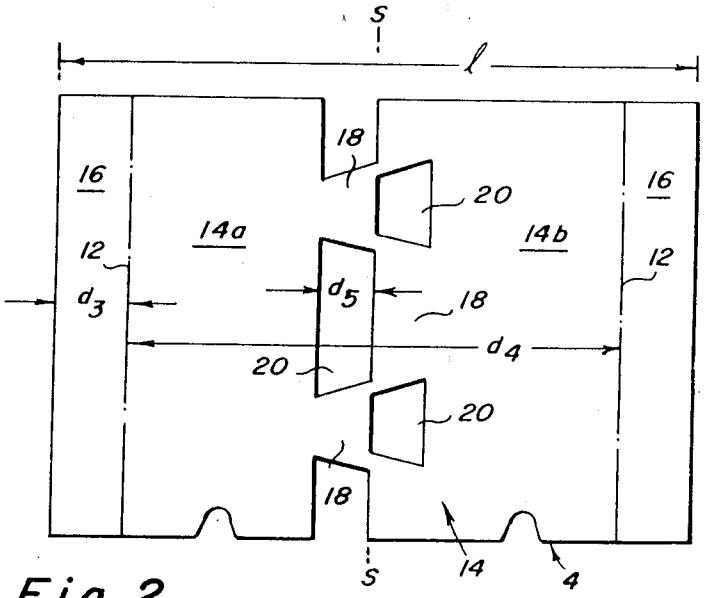

Referring more particularly first to FIGS. 1 and 2, the support pad of the present invention is formed from corresponding bottom and top rectangular blanks 2 and 4, respectively, formed from corrugated paperboard or other suitable material. In the illustrated embodiment, the blanks have the same length 1. The bottom blank is provided with a pair of first fold or score lines 6 parallel with and adjacent a first pair of opposed edges of the blank, thereby to define a first center panel 8 and a pair of first side wall panels 10. The top blank is similarly provided with a pair of second parallel fold or score lines 12 that define a second center panel 14 and a pair of second side wall panels 16. In accordance with a characterizing feature of the present invention, the second center panel 14 also contains a line of severence S intermediate and parallel with the second fold lines 12, thereby to divide the second center panel into a pair of panel portions 14*a* and 14*b*. Furthermore, cut-out portions are formed on opposite sides of the line of severence for defining a plurality of cooperating sets of dovetails 18 and grooves 20 initially arranged end-to-end as shown.

Figure 4:
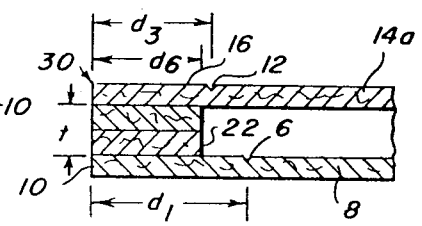
FIG. 4 is a detailed sectional view of one end of the support pad when in the initial flat condition.
Figure 3:
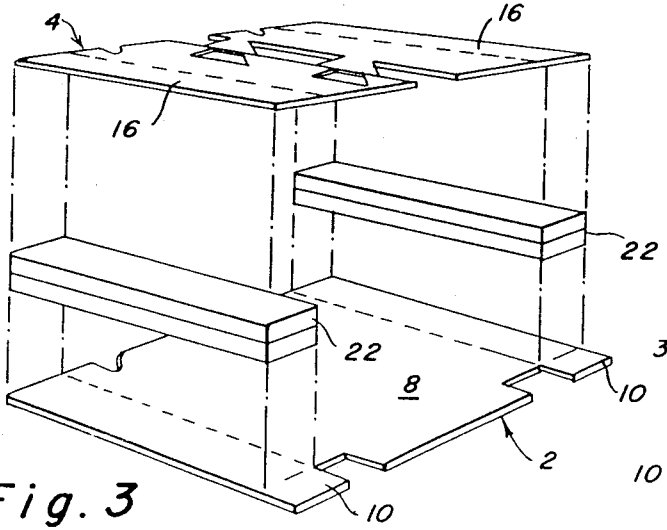
FIG. 3 is an exploded view illustrating the connection of the bottom and top panels by means of the spacer members.

Referring now to FIG. 3, the bottom and top blanks 2 and 4 are connected by a pair of spacer members 22 that are adhesively bonded between the first and second side wall panels 10 and 16, respectively, of the bottom and top blanks. In the illustrated embodiment, each spacer member 22 is formed from a plurality of layers of corrugated paperboard, or other suitable material, thereby to cause the spacer member to have a given thickness t, as shown in FIG. 4. The dimension $d_6$ of each spacer member in a direction normal to the associated fold lines is slightly less than the corresponding dimensions $d_1$ and $d_3$ of the first and second side wall panels, respectively, thereby to permit assembly of the support pad to its U-shaped configuration, as will be described below. Furthermore in order to obtain the desired interlocking relationship, fold lines 6 and 12 are preferably located in accordance with the formula:

$$d_2 \cong 2t + d_4 - d_5 \quad (1)$$

where $d_2$ = the distance between fold lines 6
t = the thickness of each spacer member
$d_4$ = the distance between fold lines 12
$d_5$ = the height of the dovetail projections

OPERATION

Figure 5:
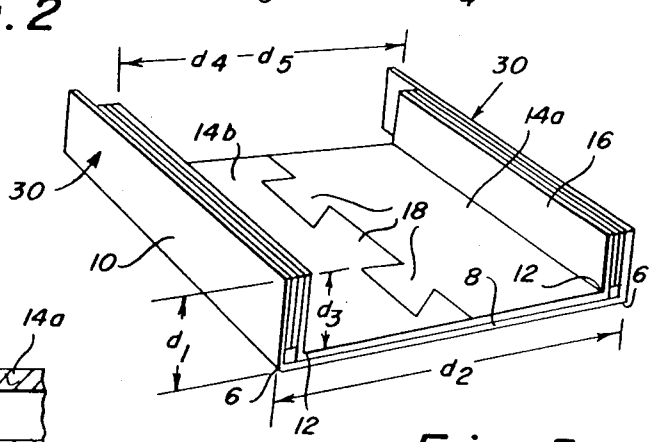
FIG. 5 is a perspective view illustrating the pad when assembled to its final U-shaped configuration.

To assemble an initially flat support pad assembly to the final U-shaped configuration of FIG. 5, the line of severence S in the center panel of the top blank is severed to define the two panel portions 14*a* and 14*b* which carry at their adjacent edges the opposed sets of dovetail projections 18 and cooperating grooves 20. The side wall assemblies 30 defined by the bonded side wall panels 10 and 16 and spacer members 22 are then pivoted upwardly about the fold lines 6 to the vertical positions illustrated in FIG. 5. Owing to the relative locations of the fold lines 6 and 12 and the dimensions $d_1$ and $d_3$ of the end panels 10 and 16, respectively, the severed portions 14*a* and 14*b* are lowered into contiguous engagement with the upper surface of the bottom central panel 8, as shown in FIG. 5. Furthermore, since the distance $d_2$ between the first fold lines 6 equals the sum of the thicknesses t of the spacer members plus the distance $d_4$ between the fold lines 12, less the height $d_5$ of the dovetail projections, the severed panel portions 14*a*, 14*b* will be displaced together by the distance $d_5$ to a position in which one severed edge area of one panel portion slightly overlaps the severed edge of the other panel portion whereupon the dovetails 18 are manually brought into interlocking engagement with the corresponding grooves 20, thereby to lock the side wall assemblies 30 in their vertical positions.

In an alternate embodiment of the invention, the spacer members are omitted (i.e., the thickness t in Equation (1) equals zero). In this embodiment, the side wall panels 10 and 16 of the respective blanks are secured directly together (by means of adhesive, staples or the like).

While in accordance with the provisions of the Patent Statutes the preferred forms and embodiments have been illustrated and described, it will be apparent that various modifications may be made without deviating from the invention set forth below.

What is claimed is:

1. A U-shaped support pad for appliances, furniture and the like, comprising (a) a rectangular horizontal bottom blank (2) having two pairs of parallel opposed edges, respectively, said blank containing a first pair of fold lines (6) parallel with and adjacent one pair of said opposed edges, respectively, thereby to define a first center panel (8) and a pair of first side wall panels (10);

(b) a rectangular horizontal top blank (4) having two pairs of parallel opposed edges, respectively, said top blank corresponding generally with and being arranged parallel with and above said bottom blank, said top blank containing a second pair of fold lines (12) parallel with said first fold lines and adjacent the corresponding edges of said top blank, respectively, thereby to define a second center (14) panel and a pair of second side wall panels (16) corresponding with said first side wall panels;

(c) first means connecting together said first and second side wall panels, respectively, thereby to define a pair of side wall assemblies (30);

(d) said second center panel containing means defining an intermediate line of severence (S) in spaced relation between and parallel with said second fold lines, said second center panel being separated along said line of severance into two severed panel portions (14*a*, 14*b*), said side wall assemblies (30) being pivoted upwardly about said first fold lines to vertical positions relative to said center panels, thereby to cause the spacing distance between said second fold lines to be less than that between said first fold lines, and the adjacent edges of said severed portions to overlap; and (e) second means (18, 20) connecting together the adjacent edges of said severed portions to maintain said side wall assemblies in their vertical positions, thereby to cause said support pad to have a U-shaped configuration.

2. A support pad as defined in claim 1, wherein said second connecting means comprises interlocking dovetail (18) and groove (20) means contained on the adjacent edges of said severed panel portions on opposite sides of said line of severance, respectively, each dovetail projection being mounted in interlocking relation with its corresponding groove.

3. A support pad as defined in claim 1, wherein said first connecting means comprises a pair of parallel spacer means (22) connected between corresponding side wall panels of said bottom and top blanks, respectively, whereby said spacer means are included in said side wall assemblies, respectively.

4. A support pad as defined in claim 3, wherein the distance ($d_2$) between said first fold lines is generally equal to the sum of the combined thickness (2t) of said spacer means plus the distance ($d_4$) between said second fold lines less the height ($d_5$) of the dovetail means.

5. A support pad as defined in claim 4, wherein the relative dimensions ($d_1$, $d_3$) of the side wall panels (10, 16) in directions normal to their associated fold lines are such that the center panel portions of the top blank are contiguous with the center panel of the bottom blank when the side wall assemblies are folded upwardly to their vertical positions.

6. A support pad as defined in claim 1, wherein said first connecting means is operable to connect corresponding first and second side wall panels in direct contiguous engagement.

7. A support pad as defined in claim 6, wherein said second connecting means comprises interlocking dovetail and groove means contained on the adjacent edges of said severed panel portions on opposite sides of said line of severance, respectively, each dovetail projection being arranged end-to-end with its corresponding groove.

* * * * *